US005645656A

United States Patent [19]

Rubianes

[11] Patent Number: 5,645,656

[45] Date of Patent: Jul. 8, 1997

[54] METHOD OF MANUFACTURING A STEEL HAVING GOOD FORMABILITY AND GOOD RESISTANCE TO INDENTATION

[75] Inventor: Jose Manuel Rubianes, Montigny Les Metz, France

[73] Assignee: Sollac, Puteaux, France

[21] Appl. No.: 528,210

[22] Filed: Sep. 13, 1995

[30] Foreign Application Priority Data

Sep. 23, 1994 [FR] France ..... 94 11481

[51] Int. Cl.[6] ..... C21D 8/02

[52] U.S. Cl. ..... 148/651

[58] Field of Search ..... 148/651

[56] References Cited

U.S. PATENT DOCUMENTS

| | | |
|---|---|---|
| 3,936,324 | 2/1976 | Uchida et al. . |
| 4,050,959 | 9/1977 | Nakaoaki et al. . |
| 5,232,524 | 8/1993 | Lafontaine et al. . |

FOREIGN PATENT DOCUMENTS

| | | |
|---|---|---|
| 0075803 | 4/1983 | European Pat. Off. . |
| 0521808 | 1/1993 | European Pat. Off. . |
| 0581629 | 2/1994 | European Pat. Off. . |
| 2291277 | 11/1976 | France . |
| 2085331 | 4/1982 | United Kingdom . |

*Primary Examiner*—Deborah Yee

*Attorney, Agent, or Firm*—Sixbey Friedman Leedom & Ferguson; Thomas W. Cole

[57] ABSTRACT

A method is provided for manufacturing a low carbon steel having good formability and good resistance to indentation. In this method, an ingot of low carbon steel is first hot-rolled, followed by a cold rolling of the resulting hot-rolled sheet. The cold-rolled sheet is then subjected to a first high temperature annealing to cause recrystallization and dissolution of some of the carbon contained in the steel. Next, the sheet is subjected to a second low temperature annealing to cause to dissolved carbon to precipitate as iron carbide. Finally, the sheet is work-hardened by a minor cold-rolling operation.

8 Claims, 3 Drawing Sheets

METHOD OF MANUFACTURING A STEEL HAVING GOOD FORMABILITY AND GOOD RESISTANCE TO INDENTATION

The invention relates to a method of manufacturing a low carbon steel having good formability and good resistance to indentation, and sheet or plate obtained by said method.

It is known, e.g., in the automobile sector, home appliance sector, or metal furniture sector, to employ low carbon sheet produced by hot rolling of an ingot followed by cold rolling, followed by hot annealing (either continuous or discrete). When such sheet is used, e.g. as the outer covering structure of an automobile body or a domestic appliance cabinet, stamping and/or bending operations are used to form the structure.

During the forming, the non-deformable parts retain their initial elastic limit Re, whereas the deformed parts have an elevated elastic limit as a result of the cold work-hardening to which they are subjected. After the parts are formed, they are generally subjected to enameling or the like, with subsequent heating to cure or develop (by firing) the enamel. Upon leaving this heat treatment, the elastic limits of the elements may have been further increased, in connection with substantial hardening of the material.

This phenomenon of hardening accompanying the baking of the enamel is known as "bake hardening" (BH).

In producing automobile body components, the steel sheet as supplied from a coil of cold rolled, annealed steel should have the lowest elastic limit Re possible in order to facilitate forming, whereas after the baking of the enamel the material of the finished piece should have a higher elastic limit, in order to confer good resistance to indentation, so as to minimize denting, scoring, and scratching of the surface as a result of contact with small objects (e.g., denting and scratching from contact of the key in the neighborhood of the door lock of an automobile). Also, a high elastic limit Re enables using a thinner sheet, thereby saving weight, which is a major consideration in automobile manufacturing.

It is known that the elastic limit of a deformed region of a sheet depends on the deformation which it has undergone during forming. Because the degree of increase in the elastic limit is largely dictated by the shape of the piece and is thus not an independent variable, it is difficult to influence it without changing the shape itself.

It is also known that a low carbon steel sheet having good stampability (thus a relatively low elastic limit) can be converted to a stamped piece with good resistance to indentation (thus a relatively high elastic limit) by maximizing the bake hardening (BH) of the steel which occurs as an incident of the baking of the enamel.

These properties are optimized by metallurgical means. A first solution to obtain a steel having good BH is to produce a steel softened or "calmed" with aluminum, without addition of titanium or niobium, possibly with addition of phosphorus and/or manganese and/or silicon, and with the use of either continuous or discrete annealing. This type of steel enables the elastic limit due to BH (i.e., following the BH) to be increased to on the order of 40 MPa.

The drawback of this solution is that the steel obtained is one which undergoes age-hardening; further, if one desires a relatively high level of the BH property, the age-hardening will be still further accentuated, and the steel will have too much carbon in solution. The mechanical characteristics of such a steel will degrade over time, particular during storage. The elastic limit will increase, and the elongation at failure and the cold work-hardening coefficient will decrease. Thus, while the coil is being warehoused, the cold work-hardening qualities of the sheet (e.g., its stampability) will degrade rapidly, wherewith there will be a risk that the situation may be reached during forming wherein the elastic limit has been essentially exceeded and stretcher strain (vermiculated strain) occurs.

A second solution consists of producing a sub-stoichiometric IF steel, with continuous annealing. Such steels are produced with the addition of titanium and/or niobium, which creates precipitates with the nitrogen and carbon in the steel, which precipitates are in the form of (among others) titanium nitride, titanium carbide, and/or niobium carbine. During the production of the steel the content of the titanium and/or niobium, as well as the content of carbon and nitrogen is monitored and to some extent controlled, which enables the controlling of the carbon content remaining in solution in the steel. In order to provide for a BH property, it is necessary to leave some of the carbon in the steel available rather than deactivated (in a precipitate or the like). If all of the carbon in the steel is rendered unavailable for BH, none is left in solution. Consequently the sheet product does not exhibit BH. Of course, it does not exhibit age-hardening either. Thus a small amount of carbon must be left in solution, representing a compromise between BH and age-hardening. This is accomplished by the stoichiometric dosing of titanium and/or niobium.

The drawback of this solution is the difficulty and complexity of carrying it out, particularly with regard to the accuracy of control of the content of titanium, niobium, carbon, and nitrogen in the steel, to correctly control the amount of dissolved carbon, in that in order to achieve the desired effect the accuracy required is on the order of parts per million (ppm). Because of this difficulty, often with the Ti/Nb precipitate method one settles for producing a steel with low BH in order to assure low age-hardening.

A third solution consists of producing the steel by the "IF CHRX" method. Such steels are produced with the addition of titanium and/or niobium in quantities such that all of the nitrogen in solution and all of the carbon in solution is initially captured in a precipitate comprised of titanium and/or niobium. The steel is then annealed by continuous annealing at a temperature above 850° C., followed by rapid cooling at a rate greater than 80° C./sec. Thus, during the production of the steel all of the carbon is captured in a precipitate by the niobium and/or the titanium; wherewith during the high temperature annealing a part of the carbon which was removed from solution is redissolved, and the rapid cooling prevents reprecipitation of the carbon.

The drawback of this solution is as follows:

- Whereas the control of the content of titanium, niobium, carbon, and nitrogen is less exacting (as to the required accuracy) than with the previously mentioned solution, such control is still complex in practice; and
- The high temperature annealing and subsequent rapid cooling (at the high rate needed to achieve the desired effect) are costly and difficult to carry out.

With this solution as well, often the tendency will be to sacrifice an appreciable amount of BH in order to alleviate the problem of age-hardening.

The present invention relates to a method of manufacturing a soft steel which method enables the above-mentioned drawbacks to be alleviated with less compromise between BH and age-hardening.

In particular, the invention relates to a method of manufacturing a soft, low carbon steel sheet by hot rolling of an ingot, followed by cold rolling of the hot-rolled sheet, followed by annealing of the cold-rolled sheet; characterized in that the first annealing of the cold-rolled sheet is an annealing involving recrystallization and dissolution of some of the carbon contained in the steel, possibly followed by an accelerated age-hardening step (a low temperature heat treatment), after which the content of the dissolved carbon is still above the specified level; and in that after the said first high temperature annealing the sheet is subjected to a second annealing, at low temperature, whereby the dissolved carbon is precipitated as iron carbide, wherewith thereafter work-hardening is effected by an additional, minor cold-rolling operation, known as a "skin pass".

According to the characteristics of the invention:

The content of carbon dissolved in the steel at the exit from the first annealing is greater than 6 ppm, preferably greater than 10 ppm.

The first annealing of the cold-rolled sheet is carded out at a temperature in the range of 750°–900° C. for a specified duration, followed by an accelerated age-hardening step in which the conditions of temperature, time, and annealing are in the domain illustrated in a temperature versus time plot comprised of the temperature range 0°–900° C. and time 0–15 minutes, not including the region A delimited by the points:

A1 (15 min, 440° C.);
A2 (40 sec, 440° C.);
A3 (40 sec, 350° C.), and
A4 (15 min, 250° C.) FIG. 2;

The rate of cooling of the cold-rolled sheet in passing from the temperature of the first annealing to the temperature of the subsequent cooling stage, and the temperature following the said cooling stage is in the range of 1°–1000° C./sec;

The temperature conditions and duration of the second annealing (low temperature) are in the domain represented in a temperature versus time plot by the region B delimited by the points:

B1 (1 hr, 50° C.),
B2 (3 min, 170° C.),
B3 (20 hr, 170° C.),
B4 (48 hr, 120° C.),
B5 (100 hr, 120° C.),
B6 (100 hr, 40° C.) FIG. 3

The second annealing is carried out at a temperature on the order to 75° C. over a long duration, on the order to 25 hours.

The soft, low carbon steel has a composition as follows (in thousandths of a percent by weight:

| | |
|---|---|
| carbon | 1–100 |
| phosphorus | 0–100 |
| aluminum | 10–100 |
| manganese | 0–1000 |
| nitrogen | 1–10 |
| silicon | 0–1000 |
| suffer | 0–25 |

with the remainder comprising iron and residuals from the production process.

The present invention also relates to steel sheet comprised of soft, low carbon steel material, which sheet is obtained according to the described method.

The characteristics and advantages of the invention will become evident in the course of the following description with reference to the accompanying drawings, which description and drawings are offered solely by way of example:

The invention relates to a method of manufacturing a sheet comprised of low carbon soft steel, which method is comprised of hot rolling of an ingot, followed by cold rolling of the hot-rolled sheet, and annealing of the cold-rolled sheet.

In order that the sheet offer good characteristics of BH and of age-hardening, the invention consists of:

carrying out a first, continuous annealing, following the cold-rolling, which annealing enables dissolution of the carbon contained in the steel, possibly followed by an accelerated age-hardening stage which reprecipitates the carbon which was in solution while limiting the decrease in the content of carbon in solution in the steel to 6 ppm, followed by a second annealing, at low temperature, wherein the carbon in solution is precipitated in the form of iron carbide followed by a work-hardening operation in the form of a minor cold-rolling (skin pass).

The soft, low carbon steel has a composition as follows (in thousandths of a percent by weight):

| | |
|---|---|
| carbon | 1–100 |
| phosphorus | 0–100 |
| aluminum | 10–100 |
| manganese | 0–1000 |
| nitrogen | 1–10 |
| silicon | 0–1000 |
| sulfur | 0–25 |

with the remainder comprising iron and residuals from the production process.

One may also use a steel having a composition similar to that described immediately, supra, but with addition of titanium and/or niobium in order to capture a part of the nitrogen and of the carbon in a precipitate, by classical means, but wherewith a certain amount of carbon is left uncombined and available to form iron carbides.

Figure 1:
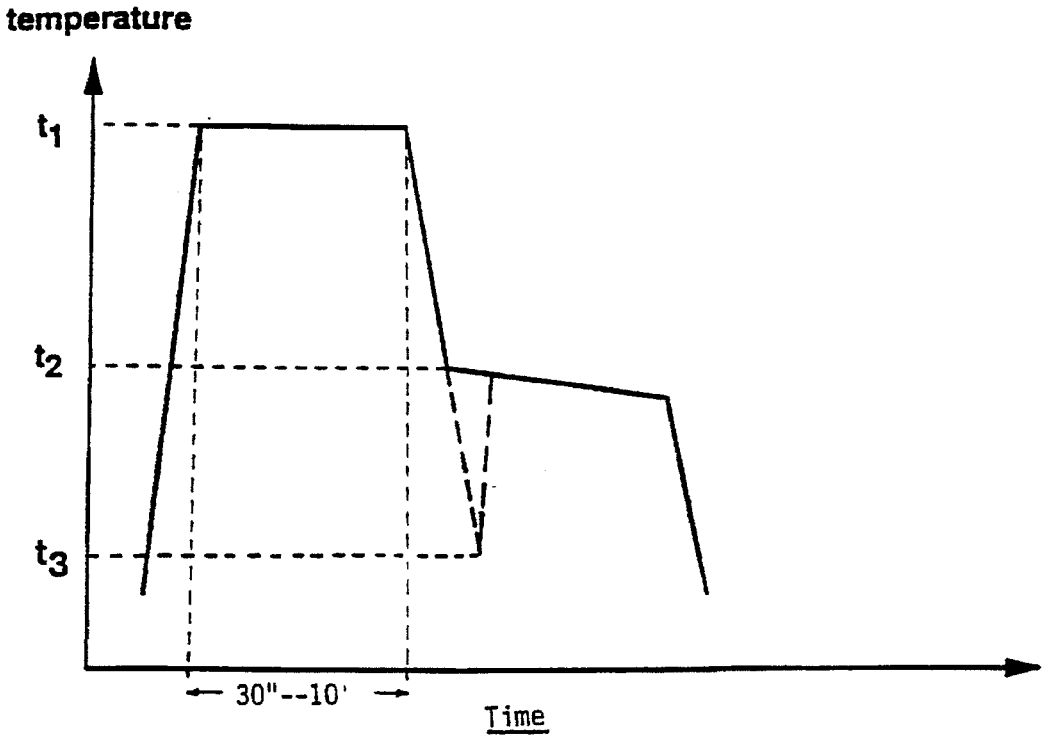
FIG. 1 shows the cycle of the first annealing of the cold-rolled steel.

As seen from FIG. 1, the cycle of the first annealing consists of increasing the temperature of the sheet to a temperature t1 in the range 750°–900° C., and maintaining this temperature for a duration of 30 sec to 10 min), then cooling the sheet to a temperature t2, and maintaining this temperature for a specified time in an accelerated age-hardening step.

It is also possible to cool the sheet rapidly to a temperature t3 (which is below t2) and then heat it rapidly to t2, following which the temperature is maintained at t2 for a specified time in an accelerated age-hardening step.

The age-hardening step need not be isothermal, but as in FIG. 1 the temperature may vary over time.

Figure 2:
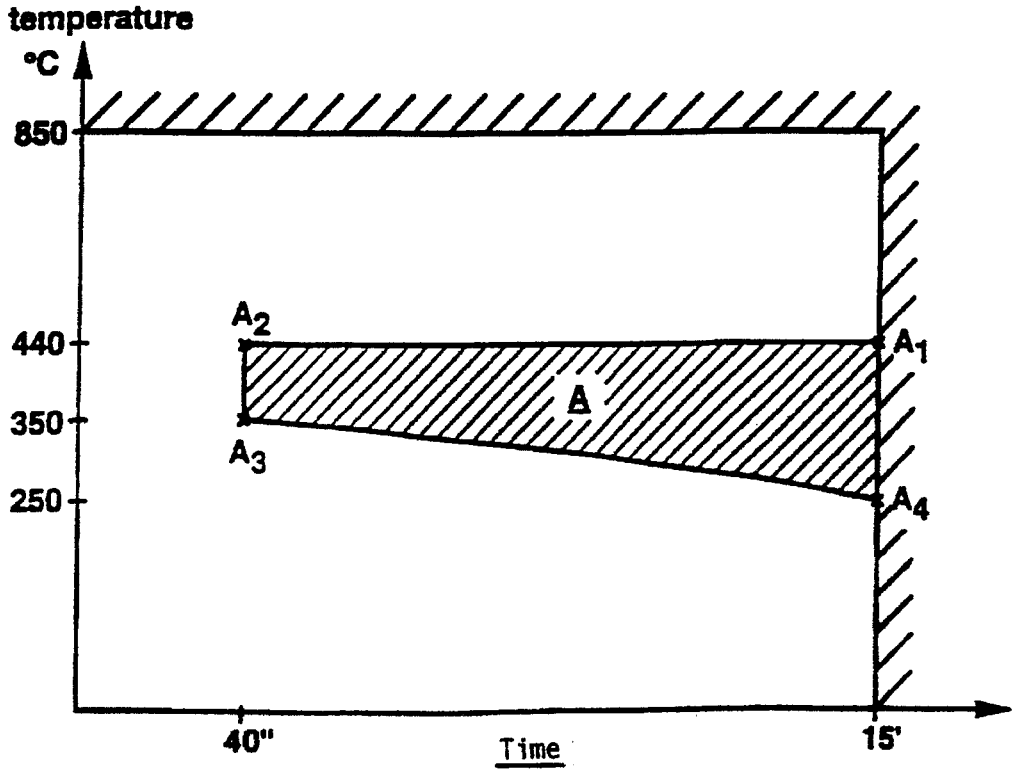
FIG. 2 shows the domain of the accelerated age-hardening step.

As seen from FIG. 2, the conditions of the temperature t2 and the duration of the accelerated age-hardening are within the non-hatched region on the plot of temperature versus time (ordinate 0°–850° C., abscissa 0–15 min), said non-hatched region being that outside the region delimited by the points:

A1 (15 min, 440° C.);

A2 (40 sec, 440° C.);

A3 (40 sec, 350° C.), and

A4 (15 min, 250° C.)

The line connecting points A3 and A4 is not straight as are those connecting A1 and A2, A2 and A3, and A4 and A1, respectively, but is curved.

As seen from FIG. 2 one may in fact obviate the accelerated age-hardening step, in that the coordinates (0,0) are part of the available non-hatched domain.

The rate of cooling of the sheet in passing from the annealing temperature t1 to the temperature t2 of the cooling step, and following the cooling step, is not of great importance in the inventive method, and e.g., may be in the range 1°–1000° C./sec.

Figure 3:
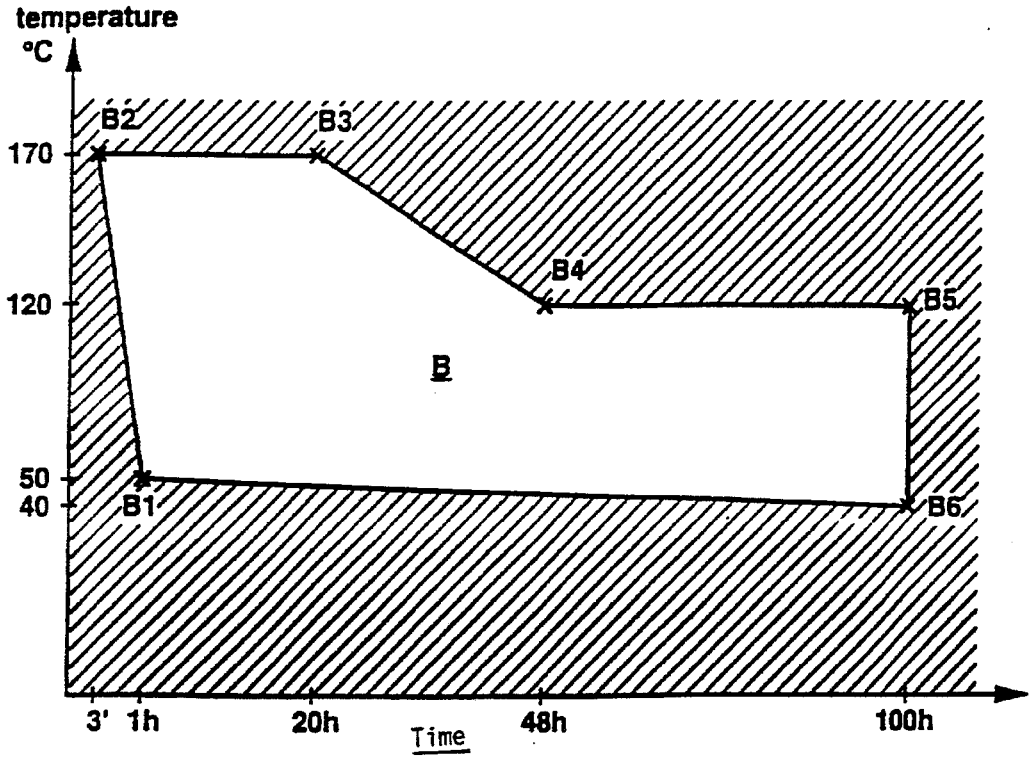
FIG. 3 shows the domain of the second annealing, at low temperature.

As seen in FIG. 3, the conditions of temperature and duration of the second low temperature annealing are within the domain represented on a temperature versus time plot by the non-hatched region B delimited by the points:

B1 (1 hr, 50° C.),

B2 (3 min, 170° C.),

B3 (20 hr, 170° C.),

B4 (48 hr, 120° C.),

B5 (100 hr, 120° C.),

B6 (100 hr, 40° C.)

Preferably the second annealing is carded out at a temperature on the order of 75° C., over a long duration, on the order of 25 hr.

This second, low temperature annealing precipitation provides an opportunity for part of the dissolved carbon to precipitate in the form of iron carbide, whereby the content of carbon in solution is decreased, wherewith the steel can have good aging properties (i.e., good stability with respect to age-hardening) so that it does not suffer major undesirable changes of properties during storage.

during the baking of the enamel, after the forming and enameling of the article, part of the iron carbide becomes redissolved to form carbon in solution, which results in beneficial BH.

Thus, the invention consists of:

a first annealing in which the lowering of the content of carbon in solution is limited, with 10–15 ppm carbon in solution being retained, followed by a second sealing, in which the carbon in solution is transformed into iron carbide, such that after baking of the enamel a sufficient amount of dissolved carbon will be present that the article will have beneficial BH (bake hardened) characteristics.

The carbon in the form of iron carbide not redissolved exerts a beneficial influence on the BH.

Numerous tests were performed on the steel having the following composition (in units of 0.0.001 wt. %):

| | | | |
|---|---|---|---|
| C | 19 | Cu | 12 |
| Mn | 203 | Ni | 30 |
| P | 9 | Cr | 15 |
| S | 9 | Sn | 1 |
| N | 5 | Nb | <5 |
| Al | 52 | Ti | <5 |
| Si | 1 | Mo | 3 |

This steel underwent cold-rolling followed by a first annealing at 800° C. and then an accelerated aging at 400° C., 30 sec. A number of samples of this steel were subjected to a second annealing at a low temperature under various conditions of temperature and time, followed by a skin-pass operation until the layer having a relatively low elastic limit was eliminated.

Each sample was then subjected to a thermal treatment (170° C., 20 min) similar to that involved in baking of an enamel.

For each sample, the following were measured:

mechanical characteristics in the direction transverse to the rolling direction;

the cold work-hardening coefficient, n, and elongation of the elastic limit (percentage plastic deformation P) after the second (low temperature) heat treatment and after the stimulated baking of the enamel.

The mechanical characteristics were measured on ISO 12.5×50 mm samples according to the standard NF EN 10002-1. Then $BH_o$ (BH without predeformation, i.e., at zero percent deformation) was calculated.

Figure 4:
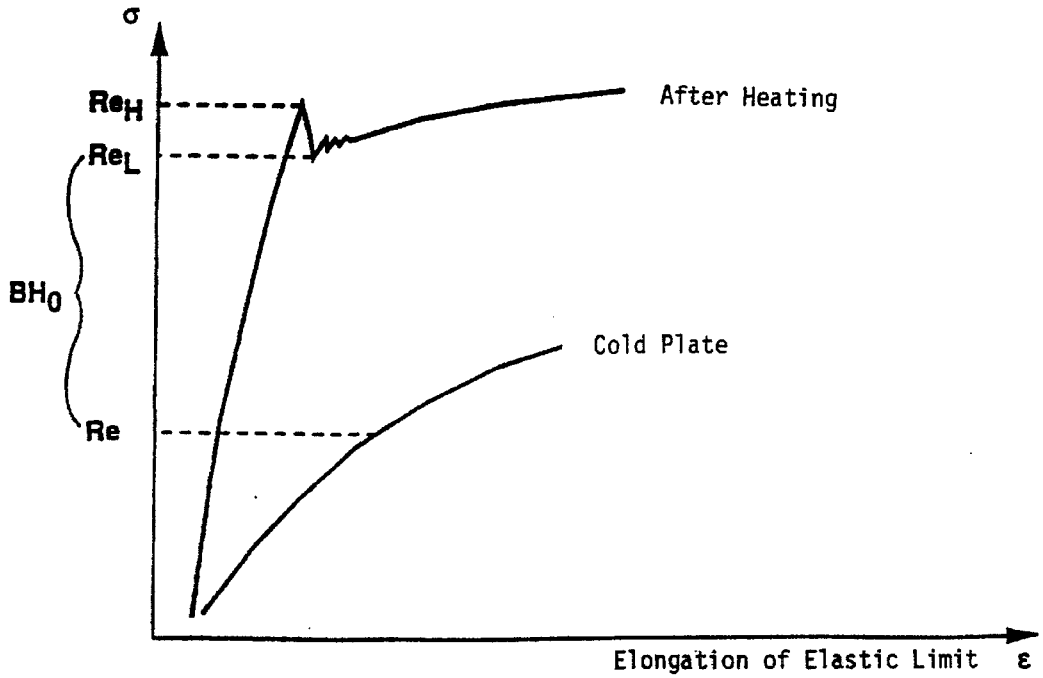
FIGS. 4 and 5 show the increase in the elastic yield point of a soft steel which characterizes its bake hardening (BH).

As illustrated in FIG. 4, the value of $BH_o$ is the difference between the lower elastic yield point after the enamel baking $Re_{L1}$, and that before the enamel baking, Re.

Figure 5:
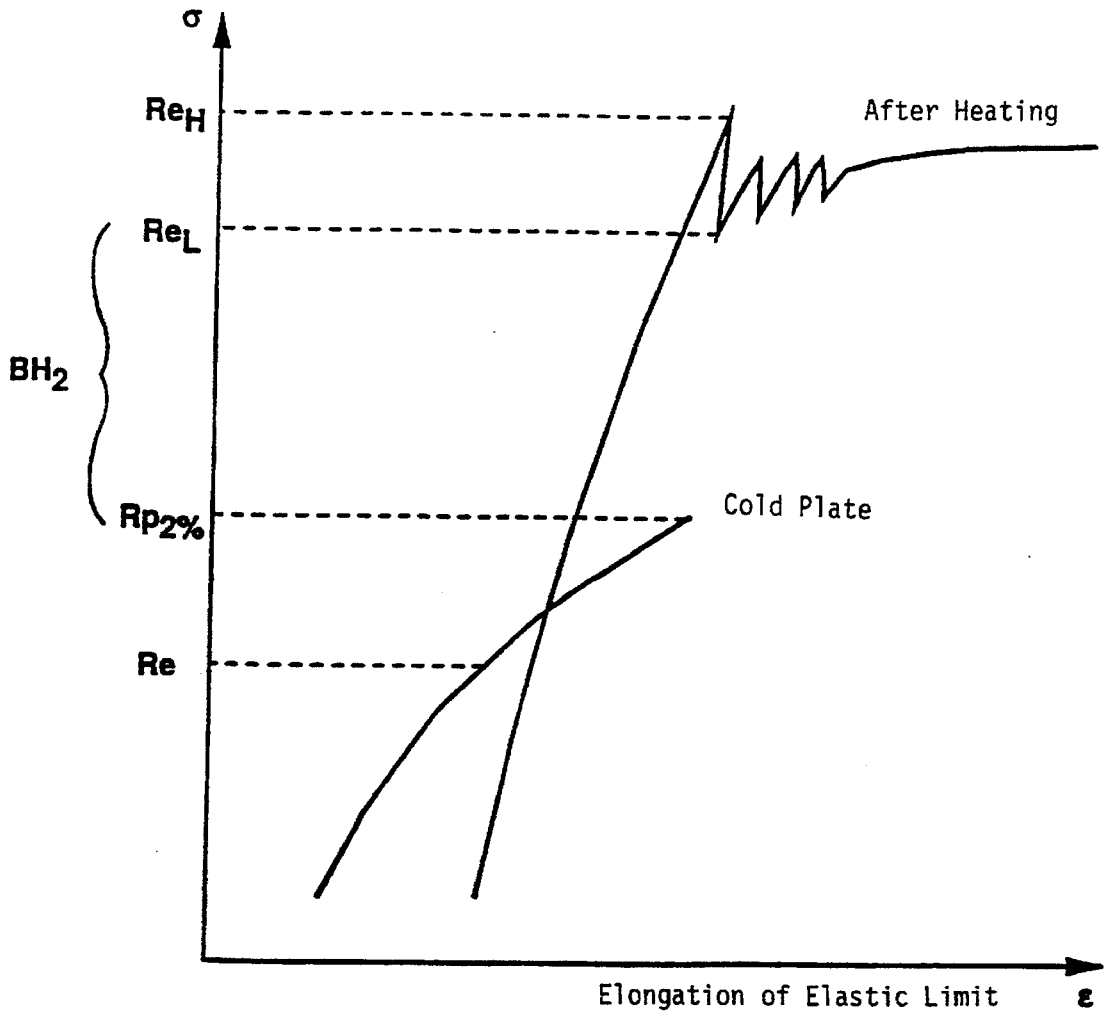

BH2, the Bh at 2% deformation, was also calculated. For this purpose, the sample which had been subjected to the first heat treatment was stretched to an elongation of 2%, following which the baking treatment was carried out. As seen from FIG. 5, BH2 is the difference between the lower elastic yield point after the baking $Re_{L2}$, and the plastic yield point after cold deformation, $Rp_{2\%}$:

$BH_2=Re_L$ (after baking heat treatment)$-R_{2\%}$ (before baking heat treatment).

The results of these tests are reported in the following Table:

| Echantillon | Traitement | P % | n | BHo (MPa) | $BH_2$ (MPa) |
|---|---|---|---|---|---|
| A | 60° C./5 h | 0.30 | 0.204 | 61 | 93 |
| B | 60° C./24 h | 0.45 | 0.214 | 53 | 88 |
| C | 75° C./1 h | 0.25 | 0.207 | 57 | 90 |
| D | 75° C./10 h | 0.30 | 0.205 | 54 | 91 |
| E | 120° C./4 h | 0.35 | 0.207 | 36 | 72 |
| F | 140° C./30" | 0.40 | 0.209 | 48 | 82 |
| G | 140° C./2 h | 0.40 | 0.210 | 41 | 72 |
| H | 160° C./1 h | 0.60 | 0.209 | 36 | 70 |

Key to Table:
Echantillon = Sample
Traitement = Treatment
h = Hours
" = Seconds

It is seen from this Table that the BH may be greater than 60 MPa, and a BH in the range 50–60 MPa is attainable without problems or difficulties. Such high values are almost never achieved with known methods.

It is also seen that the elongation at the elastic limit (P %) remains less than 0.5%. This insures that no "stretcher strain" will occur during stamping of the sheet.

Each sample was stored 30 da at ambient temperature, to enable monitoring of age-hardening. For this purpose, the coefficient of (cold) work-hardening was measured after 6, 9, 15, 22, and 30 da.

The results of this aging test are reported in the following Table:

| Echantillon | B | C | D | F | H |
|---|---|---|---|---|---|
| 1 en jours | 0.205 | 0.214 | 0.219 | 0.212 | 0.213 |
| 0 jour | 0.199 | 0.198 | 0.204 | 0.196 | 0.200 |

-continued

| Echantillon | B | C | D | F | H |
|---|---|---|---|---|---|
| 6 jours | 0.198 | 0.195 | 0.202 | 0.199 | 0.198 |
| 15 jours | 0.205 | 0.194 | 0.201 | 0.197 | 0.203 |
| 22 jours | 0.204 | 0.196 | 0.202 | 0.200 | 0.200 |
| 30 jours | 0.192 | 0.204 | 0.205 | 0.203 | 0.200 |

Key To Table:
Echantillon = Sample
Jours = Days

As seen from this Table, the coefficient of work-hardening do not vary significantly during the storage period, but remained high, which indicates a relatively low ("limited") aging characteristic as to the mechanical properties.

What is claimed:

1. A method of manufacturing a soft, low carbon steel sheet by hot rolling of an ingot, followed by cold rolling of the hot-rolled sheet, followed by a first high temperature annealing of the cold-rolled sheet; wherein the first annealing of the cold-rolled sheet is an annealing involving recrystallization and dissolution of more than 6–10 ppm of the carbon contained in the steel, followed by an optional accelerated age-hardening step after which the amount of dissolved carbon is still above 6–10 ppm; and after the first high temperature annealing the sheet is subjected to a second annealing, at low temperature, whereby the dissolved carbon is precipitated as iron carbide, wherewith thereafter work-hardening is effected by an additional, minor cold-rolling operation.

2. A method according to claim 1, wherein the amount of carbon dissolved in the steel at the exit from the first annealing is greater than 6 ppm.

3. A method according to claim 1, wherein the first annealing of the cold-rolled sheet is carried out at a temperature in the range 750°–900° C. for a duration of time in the range of 0–15 min, followed by an accelerated age-hardening step in which the conditions of temperature, time, and annealing are in the domain illustrated in FIG. 2 in a temperature versus time plot comprised of the temperature range 0°–850° C. and time 0–15 min, not including the region A delimited by the points:

A1 (15 min, 440° C.);

A2 (40 sec, 440° C.);

A3 (40 sec, 350° C.), and

A4 (15 min, 250° C.) FIG. 2;

wherewith the line connecting the points A3 and A4 is curved.

4. A method of manufacturing a soft, low carbon steel sheet by hot rolling of an ingot, followed by cold rolling of the hot-rolled sheet, followed by a first high temperature annealing of the cold-rolled sheet; wherein the first annealing of the cold-rolled sheet is an annealing involving recrystallization and dissolution of more than 6–10 ppm of the carbon contained in the steel, followed by an optional accelerated age-hardening step after which the content of dissolved carbon is still above 6–10 ppm; wherein after the said first high temperature annealing the sheet is subiected to a second annealing, at low temperature, whereby the dissolved carbon is precipitated as iron carbide, wherewith thereafter work-hardening is effected by an additional, minor cold-rolling operation; and wherein the temperature conditions and duration of the second annealing low temperature are in the domain represented in FIG. 3 in a temperature versus time plot by the region B delimited by the points:

B1 (1 hr, 50° C.),

B2 (3 min, 170° C.),

B3 (20 hr, 170° C.),

B4 (48 hr, 120° C.),

B5 (100 hr, 120° C.),

B6 (100 hr, 40° C.) FIG. 3.

5. A method according to claim 4, wherein the second annealing is carried out at a temperature on the order of 75° C. for a duration on the order of 25 hr.

6. A method according to claim 1, wherein the soft, low carbon steel has a composition as follows in thousandths of a percent by weight (ppm):

| | |
|---|---|
| carbon | 1–100 |
| phosphorus | 0–100 |
| aluminum | 10–100 |
| manganese | 0–1000 |
| nitrogen | 1–10 |
| silicon | 0–1000 |
| sulfur | 0–25 |

with the remainder comprising iron and residuals from the production process.

7. A soft, low carbon steel, produced by a method according to claim 1.

8. The method according to claim 1, wherein the temperature conditions and duration of the second annealing low temperature are in the domain represented in FIG. 3 in a temperature versus time plot by the region B delimited by the points:

B1 (1 hr, 50° C.),

B2 (3 min, 170° C.),

B3 (20 hr, 170° C.),

B4 (48 hr, 120° C.),

B5 (100 hr, 120° C.),

B6 (100 hr, 40° C.) FIG. 3.

* * * * *